US005715873A

United States Patent [19]

Figiel et al.

[11] Patent Number: 5,715,873

[45] Date of Patent: Feb. 10, 1998

[54] METHOD AND APPARATUS FOR SEALESS RETENTION OF PUSH TENSIONED STRAP

[75] Inventors: Janusz Figiel, Mt. Prospect; Peter Drabarek, Chicago; Paul Podedworny, Glenview, all of Ill.

[73] Assignee: Illinois Tool Works Inc., Glenview, Ill.

[21] Appl. No.: 711,053

[22] Filed: Sep. 9, 1996

[51] Int. Cl.[6] ..... B21F 9/02

[52] U.S. Cl. ..... 140/152; 72/93.2

[58] Field of Search ..... 72/93.2, 93.4, 72/150, 152

[56] References Cited

U.S. PATENT DOCUMENTS

| | | | |
|---|---|---|---|
| 1,273,115 | 7/1918 | Brooks | 140/93.4 |
| 2,549,626 | 4/1951 | Mosey | 140/93.2 |
| 3,794,086 | 2/1974 | Hall et al. | 140/93.2 |
| 5,501,252 | 3/1996 | Bartzick et al. | 140/93.2 |

OTHER PUBLICATIONS

Kohan Kogyo Co., Ltd. KOKO Strapping System Sales Brochure.

Signode, Manual for SHC–12/58/34 Manual Combination Strapping Tool, rev Apr. 1996, 31 pages.

Signode, Manual for SAM–12/58/34 Manual Combination Strapping Tool, rev Aug. 1989, 19 pages.

Signode, Manual for PRH–IT–1444 Push Type Power Combination Strapping Tool, rev Aug. 1989, 23 pages.

Signode, Manual for PNSC 12/58/34 Push Type Combination Strapping Tool, rev Apr. 1995, 23 pages.

*Primary Examiner*—Lowell A. Larson

*Attorney, Agent, or Firm*—Donald J. Breh

[57] ABSTRACT

A sealess strap retention apparatus for sealess joining of overlapping strap portions usable in combination with a tool for push tensioning strap about a load. The apparatus includes a first die portion and a second die movably relative to the first die portion to form a die assembly having a punch recess and a support surface for supporting the overlapping strap portions. A punch member is movable relative to the punch recess of die assembly for joining overlapping strap portions supported on the support of the die assembly. In one embodiment of the invention, the second die portion is pivotally and translatably coupled to a frame member substantially opposite the punch recess of the die assembly, wherein the second die portion is pivotally and translatably movable relative to the first die portion, and two or more punches are movable sequentially relative to corresponding punch recesses in the dies assembly to reduce loading on the die assembly during joining of the overlapping strap portions.

11 Claims, 3 Drawing Sheets

METHOD AND APPARATUS FOR SEALESS RETENTION OF PUSH TENSIONED STRAP

BACKGROUND OF THE INVENTION

The invention relates generally to a sealess strap retention method and apparatus for sealess joining of overlapping strap portions, and more specifically to a combination strap tensioning and sealess strap retention method and apparatus for sealess joining of overlapping strap portions push tensioned about relatively rigid, or small, or irregular shaped loads.

The application of tensioned strap about articles is a well known means for packaging and otherwise retaining the articles, and for this purpose there is great demand in the market place for a variety of strap and strapping tools, which apply strap about the articles. The application of sealess steel strap applied about relatively small, or rigid, or irregular shaped loads, however, has a tendency to lose tension after removal of the strapping tool. More specifically, sealess strapping tools include generally a relatively large base plate portion that is disposed between the load and the strap during tensioning and joining of the strap. The large base plate is required to support and withstand the relatively large forces exerted by a die and punch assembly that joins overlapping portions of tensioned strap. The loss in strap tension is accordingly related to the size of the base portion disposed between the strap and the load. Also, sealess strapping tools often require an actuatable pin or other means for separating a portion of the joined overlapping strap portions from the punch to facilitate removal of the strapping tool from between the strap and the load. Highly tensioned strap, however, tends to interfere with separation of the strap from the punch, and therefore interferes also with the removal of the strapping tool. Sealess type strapping tools include, for example, the Manual Combination Strapping Tools, SHC-12/58/34 and SAM-12/58/34 both available from Signode, Glenview, Ill., as well as automatically operated strapping tools.

An alternative strapping tool suitable for applying strap to relatively small, or rigid, or irregular shaped loads are push tensioning type strapping tools that apply a preformed seal to join overlapping portions of the tensioned strap. Generally, the seal is first disposed over the strap, and the free end of the strap is then disposed about the load, threaded through the seal, and folded over the seal. The push strapping tools include a strap feed wheel and a foot portion that pushes the seal toward the folded end portion of the strap as the feed wheel tensions the strap about the load. The foot portion acts on an outer edge portion of the seal, which is outside the strap loop, and the seal is cut or crimped along its edges. As a result, a relatively small portion of the push strapping tool is disposed between strap and the load compared to sealess strapping tools of the type discussed above. Push strapping tools therefore substantially reduce loss of strap tension after removal of the strapping tool. Some examples of push strapping tools include the Push Type Combination Strapping Tool, PNSC-12/58/34, and the Push Type Power Combination Strapping Tools, PRH2-114 and PRH-1T-1444, all available from Signode, Glenview, Ill. In some applications, however, it is desirable to eliminate the seal, which must be manually assembled with the strap by threading overlapping portions of the strap through the seal as discussed above.

In view of the discussion above, there exists a demonstrated need for an advancement in the art of sealess strap retention of overlapping strap portions disposed about a load.

It is therefore an object of the invention to provide a novel sealess strap retention method and apparatus for sealess joining of overlapping strap portions that overcomes problems with the prior art.

It is also an object of the invention to provide a novel sealess strap retention method and apparatus for sealess joining of overlapping strap portions without substantial loss of strap tension.

It is another object of the invention to provide a novel sealess strap retention method and apparatus having a split two-part die assembly and a punch for joining overlapping strap portions supported on the die assembly.

It is another object of the invention to provide a novel sealess strap retention method and apparatus having one die portion pivotally, or translatably, or pivotally and translatably movable relative to a fixed die portion to form a die assembly having a punch recess, wherein the movable die portion is movably coupled to a frame member opposite the punch recess of the die assembly to reduce loading on the die assembly during joining of overlapping strap portions.

It is yet another object of the invention to provide a novel sealess strap retention method and apparatus for sealess joining of overlapping strap portions having more than one sequentially operated punch to reduce loading on a die assembly during joining of overlapping strap portions.

It is a further object of the invention to provide a novel combination strap tensioning and sealess strap retention method and apparatus for sealess joining of overlapping strap portions push tensioned about a load, and in particular relatively rigid, or small, or irregular shaped loads.

The invention is, accordingly, drawn to a novel sealess strap retention apparatus for sealess joining of overlapping strap portions usable in combination with a tool for push tensioning strap about a load. According to one aspect of the invention, the apparatus includes a first die portion coupled to a frame member, and a second die movably coupled to the frame member wherein the second die portion is movable toward the first die portion to form a die assembly having a punch recess and a support surface for supporting the overlapping strap portions. A punch member is movable toward the punch recess of the die assembly for joining overlapping strap portions supported on the support surface of the die assembly. The second die portion is also movable away from the first die portion to permit separation of joined overlapping strap portions from the apparatus. According to another aspect of the invention, the second die portion is pivotally and or translatably coupled to the frame member substantially opposite the punch recess of the die assembly, wherein the second die portion is pivotally and or translatably movable relative to the first die portion. According to another aspect of the invention, two or more punches are movable sequentially toward corresponding punch recesses in the die assembly to reduce loading on the die assembly during joining of the overlapping strap portions.

These and other objects, features and advantages of the present invention will become more fully apparent upon consideration of the following Detailed Description of the Invention with the accompanying drawings, which may be disproportionate for ease of understanding, wherein like structure and steps are referenced by corresponding numerals and indicators.

DETAILED DESCRIPTION OF THE INVENTION

Figure 1:
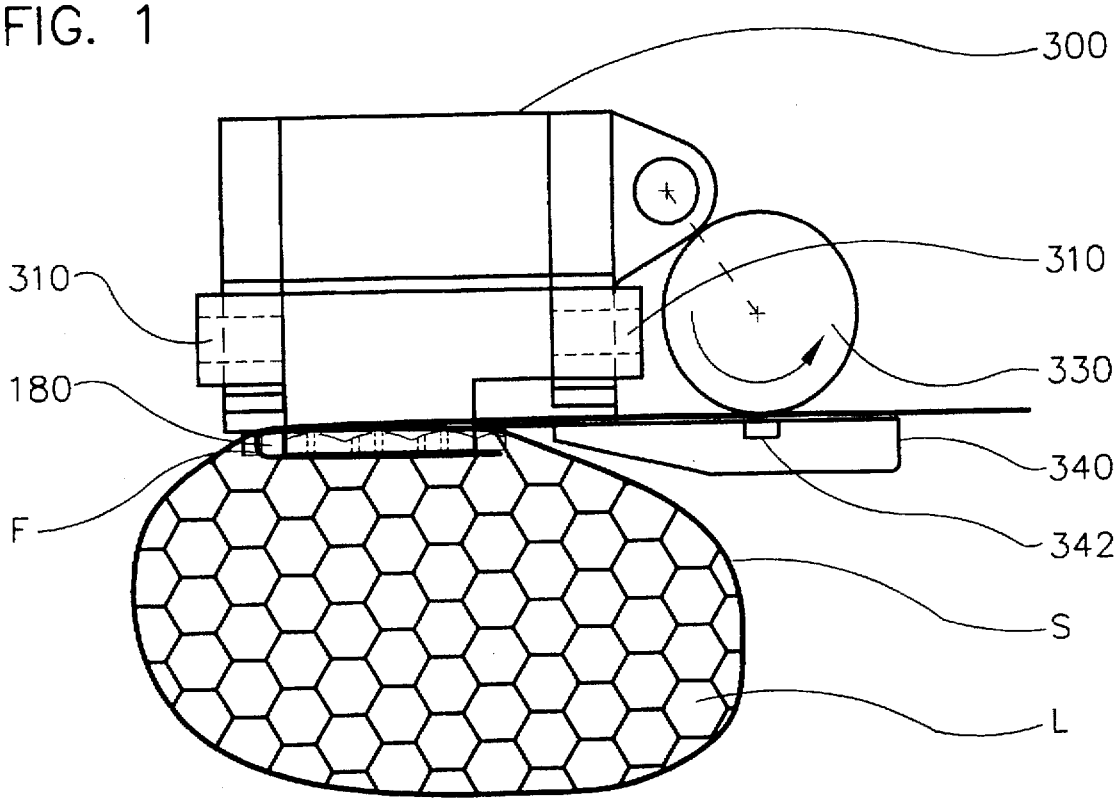
FIG. 1 is a partial side view of a sealess strap retention apparatus illustrated in combination with a strapping tool for push tensioning a strap about a load according to an exemplary embodiment of the invention.
Figure 3:
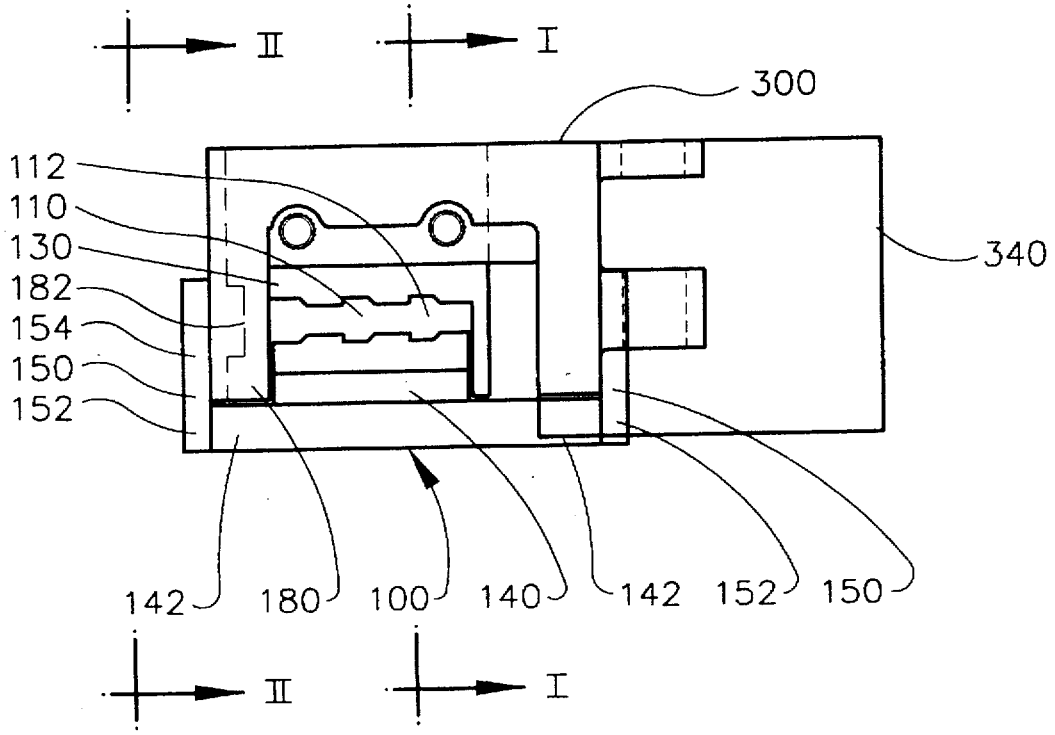
FIG. 3 is a partial plan view of FIG. 1 illustrating a two part die assembly having a fixed die portion and a movable die portion according to an exemplary embodiment of the invention.
Figure 2A:
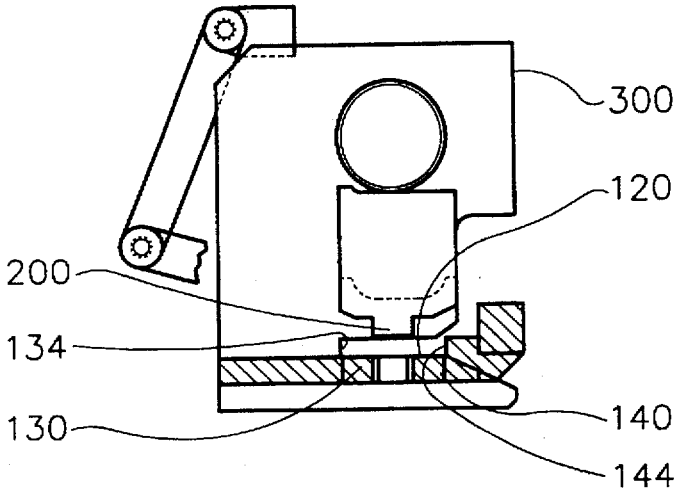
FIGS. 2*a* and 2*b* are partial sectional views taken along lines I—I of FIG. 3 illustrating a punch in upward and downward positions relative to the die assembly, respectively, according to an exemplary embodiment of the invention.
Figure 2B:
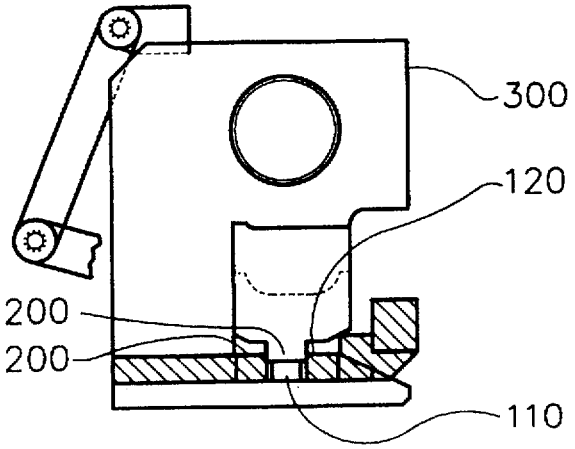

FIG. 1 is a partial side view of a sealess strap retention apparatus illustrated in combination with a strapping tool for push tensioning a strap S about a load L according to an exemplary embodiment of the invention. The operation of the combination strap tensioning and sealess strap retention apparatus according to this exemplary application of the invention is discussed further below. The sealess strap retention apparatus of the present invention, however, is usable for a variety of strap joining applications. FIGS. 2 and 3 show the sealess strap retention apparatus comprising generally a die assembly 100 with a punch recess 110 and a support surface 120 for supporting overlapping portions of a strap S, and a punch 200 movable toward the punch recess 110 of the die assembly 100 for sealess joining of the overlapping strap portions. The punch 200 is also movable away from the punch recess 110 of the die assembly 100 for ready removal of the strap from therebetween.

According to one aspect of the invention, illustrated in FIG. 3, the die assembly 100 is formed by a first die portion 130 and a second die portion 140 both coupled to a frame member 300. In one configuration, the first die portion 130 is fixed to the frame member 300 and the second die portion 140 is movably coupled to the frame member 300 wherein the second die portion 140 is movable toward the first die 130 portion to form the die assembly 100 whereupon the punch 200 is movable relative to the die assembly for joining overlapping strap portions as further discussed below. The second die portion 140 is also movable away from the first die portion 130 to permit removal of the joined overlapping strap portions from the apparatus. In FIGS. 3 and 4, at least one arm member 150 couples the second die portion 140 to the frame member 300, and in the exemplary embodiment substantially similar arm members 150 are located on opposing end portions 142 of the second die portion 140 for coupling the second die portion 140 to the frame member 300. A first end portion 152 of the arm member 150 is coupled to the second die portion 140 and a second end portion 154 of the arm member 150 is coupled to the frame member 300 wherein the second die portion 140 is movable relative to the first die portion 130.

In the exemplary embodiments, the arm member 150 is coupled to the frame member 300 substantially opposite the punch recess 110 of the die assembly 100, which is substantially along the centerline of the strap aligned on the support surface 120 of the die assembly 100, to substantially eliminate any lateral forces exerted on the die assembly 100 by the punch 200 and to reduce the load on the die assembly 100 during joining of the strap. Lateral forces exerted by the punch 200 on the die assembly 100 tend to separate the second die portion 140 from the first die portion 130 absent some means for retaining the movable die portion, which retention means are advantageously not required by the exemplary embodiments.

Figure 4A:
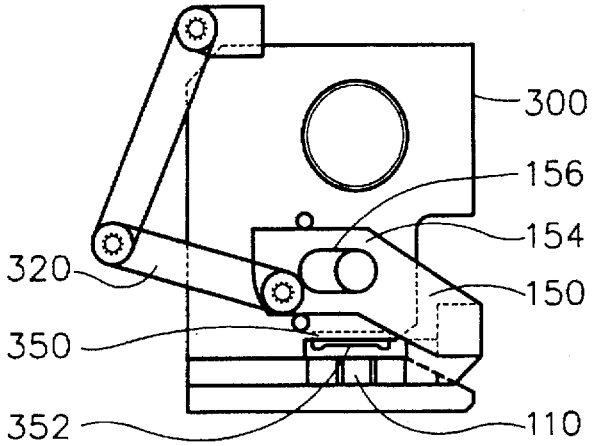
FIGS. 4*a*–4*c* are a series of partial end views taken along lines II—II of FIG. 1 illustrating translational and pivotal movement of a movable die portion relative to a fixed die portion of the two part die assembly according to an exemplary embodiment of the invention.
Figure 4B:
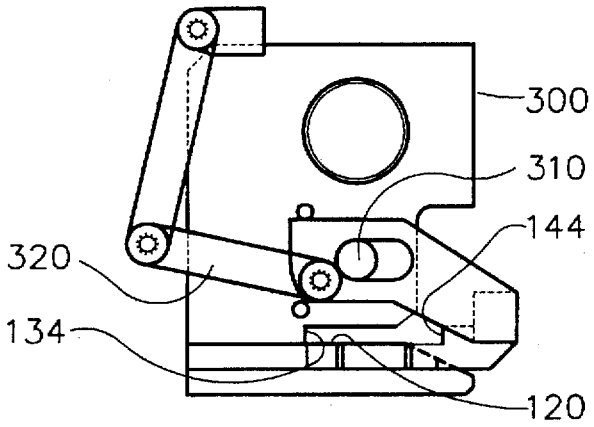
Figure 4C:
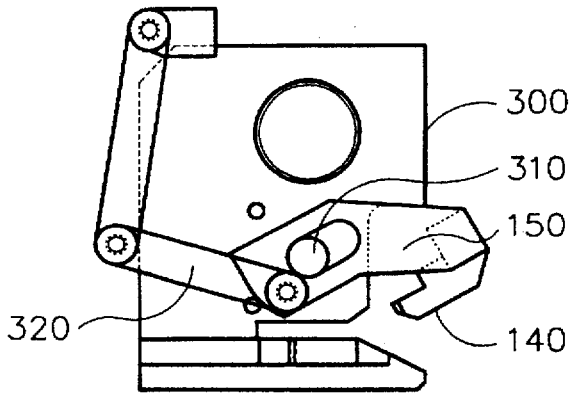

In the exemplary embodiments of FIGS. 4*a*–4*c*, an elongated slot 156 is disposed in the second end portion 154 of the arm member 150, and pin 310 extends through the elongated slot 156 for coupling the arm member 150 to the frame member 300 substantially opposite the punch recess of the die member 100. According to this configuration, the arm member 150 is translatable and pivotable relative to the pin 310 and the frame member 300 for translating and pivoting the second die portion 140 relative to the first die portion 130. FIG. 4*a* shows the second die portion 140 positioned toward the first die portion 130 to the extent permitted by the elongated slot 156 to form the die assembly 100 with the punch recess 110 and the support surface 120. FIG. 4*b* shows the arm member 150 and the second die portion 140 laterally translated relative to the pin 310 wherein the second die portion 140 is laterally translated away from the first die portion 130 to the extent permitted by the elongated slot 156. FIG. 4*c* shows the arm member 150 and the second die portion 140 pivoted about the pin 310 wherein the second die portion 140 is pivoted away from the first die portion 130. According to the exemplary embodiment, the translation and pivoting action of the second die member 140 is effected by a lever arm linkage 320 pivotally coupled to the second end portion 154 of the arm member 150. The lever arm linkage 320 is actuatable manually or automatically depending on application requirements.

According to an alternative embodiment, the arm member or members 150 are pivotally coupled to the frame member 300 wherein the second die assembly 140 is pivotal toward and away from the first die portion 130 without translational movement. This alternative configuration may be realized by replacing the elongated slot 156 with a substantially circular aperture that does not permit translation of the arm member 150 relative to the pin 310 and the frame member 300. In yet another alternative embodiment, the arm member or members 150 are translatably coupled to the frame member 300 wherein the second die assembly 140 is translatable toward and away from the first die portion 130 without pivotal movement. This alternative configuration may be realized by including structure that limits rotation of the arm member 150 about the pin 310.

The punch 200 is movable manually or automatically toward the punch recess in the die assembly 100 to join the overlapping strap portions by cutting and bending edge portions of overlapping cut strap portions, which forms a reliable joint therebetween. According to another aspect of the invention, strap joint strength is increased by including at least two or more punch members 200 movable toward corresponding recesses 110 and 112 in the die assembly 100, shown in FIG. 2, to form a series of joints along the overlapping strap portions. According to a related aspect of the invention, the load on the die assembly 100 is substantially reduced by sequentially operating, or moving, the two or more punch members 200 toward the corresponding punch recesses in the die member 100 one at a time. Reducing the load on the die assembly 100 permits reducing the material and overall size requirements of the die assembly 100, which has the beneficial effect of reducing loss of strap tension after the die assembly 100 is removed from between the strap and the load L.

According to another aspect of the invention shown in FIGS. 3 and 4, the die assembly 100 forms a strap guide for aligning overlapping strap portions on the support surface 120 of the die assembly 100. The strap guide is defined in part by a side portion 134 of the frame member 300 or first die portion 130 and an opposing side portion 144 of the second die portion 140 wherein overlapping strap portions supported on the support surface 120 of the die assembly 100 are disposed and retained between the opposing side portions 134 and 144 thereby ensuring proper alignment of overlapping strap portions during the strap joining operation of the punch member or members 200. Movement of the second die portion 140 away from the first fixed die portion 130 permits ready removal of the joined overlapping strap portions from the strap guide of the apparatus.

FIG. 1 illustrates a combination strap tensioning and sealess strap retention apparatus for sealess joining of overlapping strap portions push tensioned about a load L. In addition to one of the die assembly 100 and punch 200 configurations discussed above, the combined apparatus includes a strap engaging end portion 180 formed by the first die portion 130, which may include a recessed portion 182, shown in FIG. 3, for seating a folded strap portion F. The combined apparatus includes a strap feed wheel 330 rotatably coupled to the frame 300 and pivotally positionable relative to a tensioner plate 340. A gripper plug 342 may alternatively be disposed in a recess in the tensioner plate to facilitate feeding the strap S between the strep feed wheel 330 and the tensioner plate 340. FIG. 4*a* shows the combined apparatus including a strap cutting blade 350 for severing a free strap end portion from the joined strap. In the exemplary embodiment, the strap cutting blade has a concave blade portion 352 for folding downwardly cut end portions of the strap S, which and substantially reduces any sharp edges.

In one exemplary mode of operation shown in FIG. 1, a folded strap end portion F is disposed over the strap engaging end portion 180 when the second die portion 140 is moved away from the first die portion 130, and the strap S is formed in a loop about the load L. A free end of the strap S is disposed overlapping the folded strap portion F on the support surface 120 of the die assembly 100 when the second die 140 is moved away from the first die 130, and the free end of the strap S is disposed between the strap feed wheel 330 and the tensioner plate 340. The overlapping strap portions are maintained in alignment on the support surface 120 of the die assembly 100 by the side portions 134 and 144 of the strap guide when the second die portion 140 is moved toward the first die portion 130. The feed wheel 330, which may be operated manually or automatically, tensions the strap about the load L whereafter the overlapping strap portions are joined by the die assembly 100 and punch 200 as discussed above. The joined strap is then cut with the cutting blade, which may also be operated either manually or automatically. The second die portion 140 is then moved away from the first die portion 130 as discussed above to separate or remove the combination strap tensioning and sealess strap retention apparatus from the strap. FIG. 1 illustrates most clearly that a relatively small portion of the die assembly 100 is disposed between the strap S and the load L thereby minimizing the loss of strap tension upon removal of the apparatus. And the relatively reduced size of the die assembly 100 obtained by using a split two-part die assembly and by supporting the second die 140 from the frame opposite the punch recess 110, or strap centerline, substantially reduces any adverse affect on strap tension after removal of the apparatus as discussed above.

While the foregoing written description of the invention enables anyone skilled in the art to make and use what is at present considered to be the best mode of the invention, it will be appreciated and understood by those skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A sealess strap retention apparatus for sealess joining of overlapping strap portions usable in combination with a tool for push tensioning strap about a load, the apparatus comprising:

a frame member;

a first die portion coupled to the frame member;

a second die portion movably coupled to the frame member, the second die portion movable toward the first die portion to form a die assembly with a punch recess and a support surface for supporting overlapping strap portions, the second die portion movably coupled to the frame member substantially opposite the punch recess of the die assembly;

at least one punch member movable relative to the punch recess of the die assembly for joining overlapping strap portions supported on the support surface of the die assembly, wherein the second die portion is movable away from the first die portion to permit separation of joined overlapping strap portions from the apparatus.

2. The apparatus of claim 1 further comprising at least one arm member for movably coupling the second die portion and the frame member, a first end portion of the arm member coupled to the second die portion, and a second end portion of the arm member pivotally coupled to the frame member substantially opposite the punch recess substantially along a centerline of overlapping strap portions supported on the support surface of the die assembly, wherein the second die portion is pivotally movable relative to the first die portion.

3. The apparatus of claim 1 further comprising at least one arm member for movably coupling the second die portion and the frame member, a first end portion of the arm member coupled to the second die portion, and a second end portion of the arm member having an elongated slot, a pin extended through the elongated slot for coupling the arm member to the frame member substantially opposite the punch recess of the die assembly, wherein the arm member is translatable and pivotable relative to the pin and the frame member for translating and pivoting the second die portion relative to the first die portion.

4. The apparatus of claim 1 further comprising a base with a strap guide formed by the die assembly for aligning overlapping strap portions on the surface of the die assembly, and a strap engaging end portion formed by the first die portion for engaging a folded strap portion while tensioning strap.

5. The apparatus of claim 1 further comprising at least two punch members sequentially movable toward corresponding punch recesses in the die assembly for reducing a load on the die assembly when joining overlapping strap portions supported on the support of the die assembly.

6. A combination strap tensioning and sealess strap retention apparatus for sealess joining of overlapping strap portions push tensioned about a load, the apparatus comprising:

a frame member;

a first die portion coupled to the frame member;

a second die portion movably coupled to the frame member, the second die portion movable toward the first die portion to form a die assembly with a punch recess and a support surface for supporting overlapping strap portions, the second die portion movably coupled to the frame member substantially opposite the punch recess of the die assembly;

at least one punch member movable toward the punch recess of die assembly for joining overlapping strap portions supported on the support surface of the die assembly;

a strap engaging end portion formed by the first die portion for engaging a folded strap portion;

a strap feed wheel for tensioning a strap portion overlapping the folded strap portion engaged by the strap engaging end portion;

wherein the punch member is movable away from the punch recess of the die assembly, and wherein the second die portion is movable away from the first die portion to permit separation of joined overlapping strap portions from the apparatus.

7. A sealess strap retention method for sealess joining of overlapping strap portions usable in combination with a tool for push tensioning strap about a load, the method comprising steps of:

moving a second die portion toward a first die portion to form a die assembly with a punch recess and a support surface for supporting overlapping strap portions, the first die portion coupled to a frame member and the second die portion movably coupled to the frame member substantially opposite the punch recess of the die assembly;

joining overlapping strap portions supported on the support surface of the die assembly with at least one punch member movable toward the punch recess of die assembly; and separating the joined overlapping strap portions from the apparatus by moving the punch member away from the punch recess of the die assembly and moving the second die portion away from the first die portion.

8. The method of claim 7 wherein the step of moving the second die portion toward the first die portion to form the die assembly includes a step of pivoting the second die portion relative to the first die portion with at least one arm member interconnecting the second die portion and the frame member, a first end portion of the arm member coupled to the second die portion, and a second end portion of the arm member pivotally coupled to the frame member substantially opposite the punch recess of the die assembly substantially along a centerline of overlapping strap portions supported on the support surface.

9. The method of claim 7 wherein the step of moving the second die portion toward the first die portion to form the die assembly includes steps of translating and pivoting the second die portion relative to the first die portion with at least one arm member interconnecting the second die portion and the frame member, a first end portion of the arm member coupled to the second die portion, and a second end portion of the arm member having an elongated slot translatably and pivotally coupled to the frame member by a pin substantially opposite the punch recess of the die assembly.

10. A sealess strap retention apparatus for sealess joining of overlapping strap portions usable in combination with a tool for push tensioning strap about a load, the apparatus comprising:

a frame member;

a first die portion coupled to the frame member;

a second die portion movably coupled to the frame member, the second die portion movable toward the first die portion to form a die assembly with a punch recess and a support surface for supporting overlapping strap portions, at least one arm member for movably coupling the second die portion to the frame member, a first end portion of the arm member coupled to the second die portion, and a second end portion of the arm member translatably coupled to the frame member, the second die portion translatably movable relative to the first die portion;

at least one punch member movable relative to the punch recess of the die assembly for joining overlapping strap portions supported on the support surface of the die assembly, wherein the second die portion is movable away from the first die portion to permit separation of joined overlapping strap portions from the apparatus.

11. The apparatus of claim 10 further comprising an elongated slot in the second end portion of the arm member, and a pin extended through the elongated slot for coupling the arm member to the frame member, wherein the arm member is translatable and pivotable relative to the pin and the frame member for translating and pivoting the second die portion relative to the first die portion.

* * * * *